US010337168B2

(12) United States Patent
Sewell

(10) Patent No.: US 10,337,168 B2
(45) Date of Patent: Jul. 2, 2019

(54) TRENCHING ASSEMBLY

(71) Applicant: The Charles Machine Works, Inc., Perry, OK (US)

(72) Inventor: Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 15/612,044

(22) Filed: Jun. 2, 2017

(65) Prior Publication Data

US 2017/0350093 A1 Dec. 7, 2017

Related U.S. Application Data

(60) Provisional application No. 62/344,735, filed on Jun. 2, 2016.

(51) Int. Cl.
*E02F 5/14* (2006.01)
*E02F 5/08* (2006.01)

(52) U.S. Cl.
CPC . *E02F 5/08* (2013.01); *E02F 5/14* (2013.01)

(58) Field of Classification Search
CPC ..... E02F 5/022; E02F 5/08
USPC ..... 37/91, 92, 189
See application file for complete search history.

(56) References Cited

U.S. PATENT DOCUMENTS 2,089,094 A 8/1937 Kime
3,402,816 A 9/1968 Taylor
3,439,806 A 4/1969 Kass et al.
3,849,017 A 11/1974 Rochfort
3,877,830 A 4/1975 James
4,071,226 A 1/1978 Miller
4,221,505 A 9/1980 Taylor-Smith
4,319,859 A 3/1982 Wise
(Continued)

FOREIGN PATENT DOCUMENTS

FR 1386111 A 1/1965
FR 2749866 A1 12/1997
(Continued)

OTHER PUBLICATIONS

European Patent Office, "Supplementary European Search Report", dated Jul. 10, 2015, 2 pages, Munich, Germany.
(Continued)

*Primary Examiner* — Gary S Hartmann
(74) *Attorney, Agent, or Firm* — Tomlinson McKinstry, P.C.

(57) ABSTRACT

A trenching assembly used to cut a narrow trench in the ground surface. The trenching assembly comprises an attachment frame connected to a hood assembly via a linkage assembly. The attachment frame may be attached to the rear end of a work machine. A rotatable blade is disposed within a cavity defined by the hood assembly. The hood assembly may rotate about two different axes relative to the linkage assembly, and the linkage assembly may rotate about two different axes relative to the attachment frame. The trenching assembly uses a pair of accumulators to hydraulically rotate the linkage assembly about a horizontal axis relative to the frame in response changes in depth of the ground surface being cut by the blade. The linkage assembly may be hydraulically rotated using the accumulators without input from the operator.

25 Claims, 16 Drawing Sheets

(56) References Cited

U.S. PATENT DOCUMENTS

| | | | | |
|---|---|---|---|---|
| 4,326,347 | A | 4/1982 | Ballinger | |
| 4,377,365 | A | 3/1983 | Layh | |
| 4,383,651 | A | 5/1983 | Couperus | |
| 4,496,265 | A | 1/1985 | Fragale | |
| 4,507,012 | A | 3/1985 | Corcoran et al. | |
| 4,695,186 | A | 9/1987 | King | |
| 4,768,297 | A | 9/1988 | Rivard | |
| 4,786,111 | A | 11/1988 | Yargici | |
| 4,794,709 | A | 1/1989 | Rivard | |
| 4,806,043 | A | 2/1989 | Fournier | |
| 4,812,078 | A | 3/1989 | Rivard | |
| 4,830,533 | A | 5/1989 | Miller | |
| 4,831,958 | A | 5/1989 | Selby | |
| 4,838,734 | A | 6/1989 | Pinto | |
| 4,914,840 | A | 4/1990 | Porter | |
| 4,958,457 | A | 9/1990 | Doskocil | |
| 5,116,162 | A | 5/1992 | Burnhite | |
| 5,120,217 | A | 6/1992 | O'Brien et al. | |
| 5,158,394 | A | 10/1992 | Bresnahan | |
| 5,203,101 | A | 4/1993 | Bryan | |
| RE34,289 | E | 6/1993 | McClain et al. | |
| 5,287,933 | A | 2/1994 | Lindblom | |
| 5,297,497 | A | 3/1994 | Schmidt | |
| 5,315,770 | A | 5/1994 | Campbell | |
| 5,373,902 | A | 12/1994 | Lindblom | |
| 5,381,616 | A | 1/1995 | Disney | |
| 5,427,470 | A | 6/1995 | McKim | |
| 5,431,233 | A | 7/1995 | Schmidt | |
| 5,490,339 | A | 2/1996 | Accettola | |
| 5,573,347 | A | 11/1996 | Miles | |
| 5,575,538 | A | 11/1996 | Gilbert et al. | |
| 5,846,022 | A | 12/1998 | Grundl | |
| 5,848,871 | A | 12/1998 | Thiessen | |
| 5,864,971 | A | 2/1999 | Jones | |
| 5,873,186 | A | 2/1999 | Yoder et al. | |
| 5,873,396 | A | 2/1999 | Biebrach | |
| 5,988,935 | A | 11/1999 | Dillingham | |
| 6,012,870 | A | 1/2000 | Dillingham | |
| 6,050,744 | A | 4/2000 | Binning | |
| 6,055,750 | A | 5/2000 | Yoder et al. | |
| 6,189,244 | B1 | 2/2001 | Johnson et al. | |
| 6,213,680 | B1 | 4/2001 | Schaeffer et al. | |
| 6,283,697 | B1 | 9/2001 | Pierce et al. | |
| 6,345,931 | B1 | 2/2002 | Capece | |
| 6,371,691 | B1 | 4/2002 | Finzel et al. | |
| 6,402,123 | B1 | 6/2002 | Rivard | |
| 6,439,806 | B1 | 8/2002 | Dillingham | |
| 6,467,201 | B1 | 10/2002 | McSharry et al. | |
| 6,508,606 | B1 | 1/2003 | James | |
| 6,558,079 | B1 | 5/2003 | Kozak et al. | |
| 6,637,978 | B1 | 10/2003 | Genta | |
| 6,718,660 | B2 | 4/2004 | Rivard | |
| 6,763,925 | B2 | 7/2004 | Woods | |
| 6,830,412 | B2 | 12/2004 | Perez | |
| 6,866,448 | B2 | 3/2005 | Finzel et al. | |
| 6,966,725 | B2 | 11/2005 | Cochran | |
| 7,255,512 | B2 | 8/2007 | Wallace | |
| 7,377,719 | B1 | 5/2008 | Elizondo et al. | |
| 7,441,987 | B1 | 10/2008 | Sampey | |
| 7,488,149 | B2 | 2/2009 | Waldner | |
| 7,510,365 | B2 | 3/2009 | Babiarz | |
| 7,581,339 | B2 | 9/2009 | Mizoroke et al. | |
| 7,716,773 | B1 | 5/2010 | Pahl | |
| 7,784,996 | B1 | 8/2010 | Cummer | |
| 7,886,463 | B2 | 2/2011 | Greenberg et al. | |
| 7,959,697 | B2 | 6/2011 | Francis | |
| 8,016,516 | B2 | 9/2011 | Johnson et al. | |
| 8,061,344 | B2 | 11/2011 | Dofher | |
| 8,157,477 | B2 | 4/2012 | Horan et al. | |
| 8,272,493 | B1 | 9/2012 | Grengs | |
| 8,308,394 | B2 | 11/2012 | Whitley | |
| 8,375,605 | B2 | 2/2013 | Ruhl et al. | |
| 8,465,225 | B2 | 6/2013 | Groulx et al. | |
| 8,562,249 | B2 | 10/2013 | Owegeser | |
| 8,573,886 | B1 | 11/2013 | Taylor | |
| 8,806,784 | B2 | 8/2014 | Ruhl et al. | |
| 8,888,403 | B2 | 11/2014 | Atherton | |
| 9,102,460 | B2 | 8/2015 | Pylinski | |
| 9,103,099 | B2 * | 8/2015 | Cutler | E02F 3/20 |
| 9,194,103 | B2 * | 11/2015 | McGee | E02F 5/08 |
| 9,267,620 | B2 * | 2/2016 | Sjodahl | E02F 3/188 |
| 9,695,573 | B2 * | 7/2017 | Sewell | E02F 5/14 |
| 9,752,301 | B2 * | 9/2017 | Ruhl | E02F 3/183 |
| 2001/0023766 | A1 | 9/2001 | Ohtomo et al. | |
| 2002/0044830 | A1 | 4/2002 | Munie | |
| 2002/0060125 | A1 | 5/2002 | Woods | |
| 2003/0215288 | A1 | 11/2003 | Causie et al. | |
| 2004/0148823 | A1 | 8/2004 | Schenk | |
| 2009/0007460 | A1 | 1/2009 | Greenlee et al. | |
| 2009/0035110 | A1 | 2/2009 | Woods | |
| 2012/0046838 | A1 | 2/2012 | Landphair et al. | |
| 2012/0328370 | A1 * | 12/2012 | Gustafsson | E02F 3/188 405/157 |
| 2013/0145657 | A1 * | 6/2013 | Ruhl | E02F 3/183 37/94 |
| 2014/0105683 | A1 | 4/2014 | McKinnon | |
| 2014/0345169 | A1 | 11/2014 | Ruhl et al. | |
| 2014/0377022 | A1 | 12/2014 | Seever | |
| 2015/0218777 | A1 | 8/2015 | Sewell et al. | |
| 2016/0376767 | A1 * | 12/2016 | Miller | E02F 5/08 37/94 |
| 2017/0101746 | A1 | 4/2017 | Sewell | |
| 2017/0254046 | A1 * | 9/2017 | Risi | E02F 3/183 |
| 2017/0298594 | A1 * | 10/2017 | Sewell | E02F 5/14 |

FOREIGN PATENT DOCUMENTS

| | | | |
|---|---|---|---|
| GB | 1380398 | A | 1/1975 |
| WO | 0123677 | A1 | 4/2001 |

OTHER PUBLICATIONS

International Searching Authority, "Patent Corporation Treaty PCT Search Report", dated Jan. 29, 2013, 3 pages, Korea.

United States Patent and Trademark Office, "Office Action Summary", dated Nov. 20, 2014, U.S. Appl. No. 13/540,236, 10 pages, Alexandria, VA.

United States Patent and Trademark Office, "Office Action Summary", dated May 4, 2015, U.S. Appl. No. 13/540,236, 10 pages, Alexandria, VA.

United States Patent and Trademark Office, "Office Action Summary", dated Oct. 16, 2015, U.S. Appl. No. 13/540,236, 12 pages, Alexandria, VA.

United States Patent and Trademark Office, "Office Action Summary", dated Sep. 6, 2016, U.S. Appl. No. 13/540,236, 13 pages, Alexandria, VA.

United States Patent and Trademark Office, "Office Action Summary", dated May 19, 2017, U.S. Appl. No. 13/540,236, 10 pages, Alexandria, VA.

* cited by examiner

TRENCHING ASSEMBLY

CROSS REFERENCE TO RELATED APPLICATION

This application claims the benefit of U.S. Provisional Application Ser. No. 62/344,735, filed on Jun. 2, 2016, the entire contents of which are incorporated herein by reference.

SUMMARY

The present invention is directed to a trenching assembly comprising an elongate frame that extends along a longitudinal axis, a pivot arm positioned rearwardly of the frame along a pivot arm axis orthogonal to the frame axis, and a linkage interconnecting the frame and the pivot arm. The trenching assembly further comprises a hood connected to the pivot arm and rotatable about a hood axis that extends parallel to the pivot arm axis, and a rotatable blade positionable at least partially within the hood.

The present invention is also directed to a method for cutting a narrow trench in a direction of travel using a rotatable blade attached to a frame via a linkage assembly, wherein the rotatable blade is disposed within a cavity defined by a hood assembly having a surface-engaging member. The method comprises the steps of positioning the surface-engaging member on the surface adjacent the blade, adjusting a vertical position of the blade relative to the surface engaging member to achieve the desired trench depth, rotating the blade to cut a trench, and translating the frame in the direction of travel. The method further comprises the step of pivoting the linkage assembly about an axis horizontal to the direction of travel by passing hydraulic fluid between an accumulator supported on the frame and a hydraulic cylinder attached to the linkage assembly.

DETAILED DESCRIPTION

Figure 1:
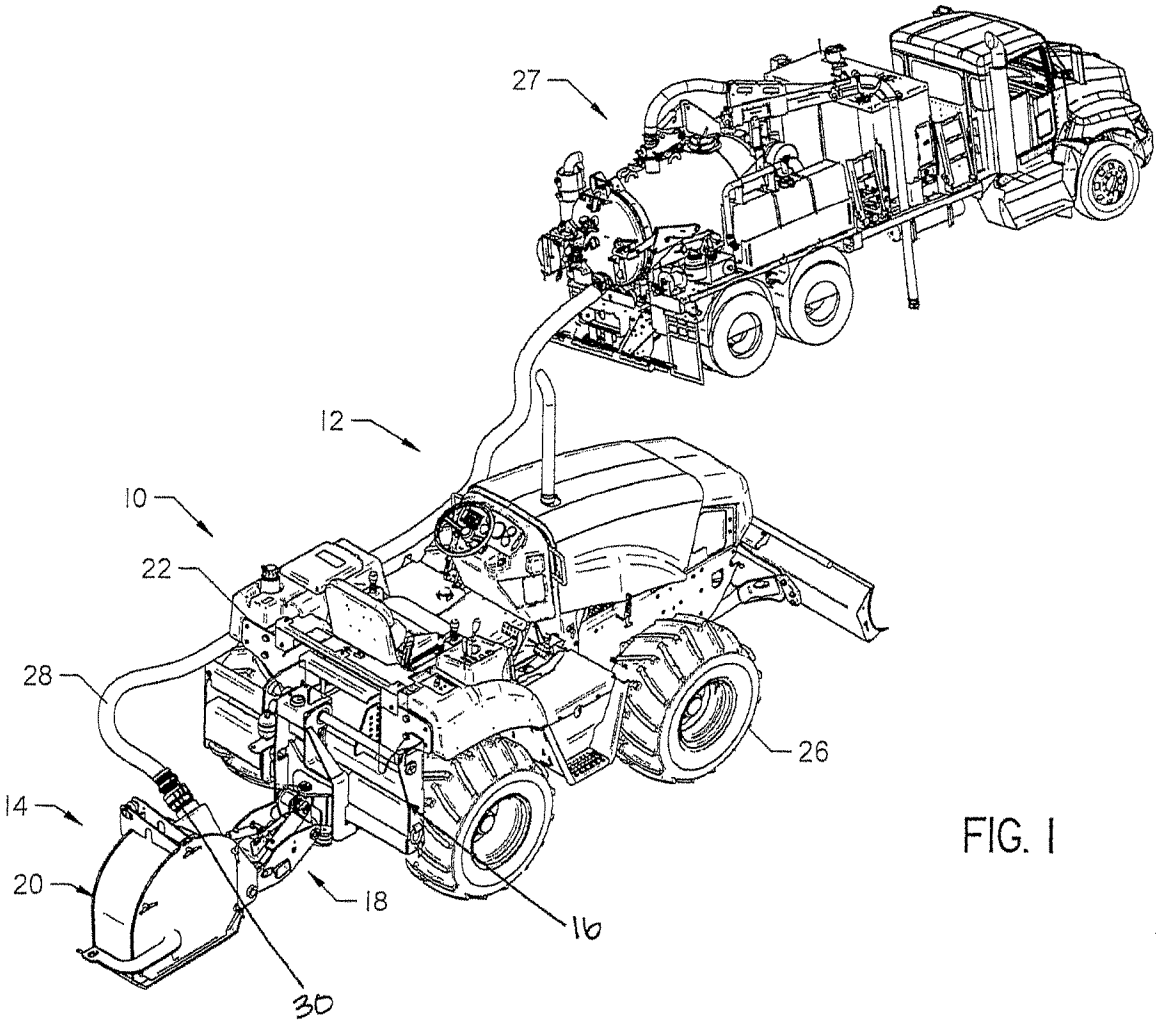
FIG. 1 is a side view of a trenching assembly of the present invention attached to the rear end of a work machine and a vacuum system connected to the work machine and the trenching assembly via a hose.

FIG. 1 shows a mobile system 10 for cutting a narrow trench of varying depths and widths in a surface such as a concrete or asphalt roadway or the natural ground surface. The system to comprises a work machine 12 and a trenching assembly 14 attached to the work machine. The trenching assembly 14 comprises an elongate attachment frame 16, a linkage assembly 18, and a hood assembly 20. The linkage assembly 18 connects the hood assembly 20 to the attachment frame 16. The attachment frame 16 is supported on a rear end 22 of the work machine 12. A rotatable blade 24 (FIG. 2) is disposed within a cavity defined by the hood assembly 20. The blade 24 cuts the trench as the trenching assembly 14 is pulled behind the work machine 12.

It should be understood that a "narrow trench", generally, means a trench that is deeper than it is wide. In the context of the trenching assembly 14, such narrow trenches are typically from one half inch to three inches in width, with a depth of six to eighteen inches. A preferred dimension may be one and a half inches wide by twelve inches deep, though varying the depth, as described herein, may be advantageous.

Varying the width of a trench may be accomplished by changing the blade 24 used, or by adjusting teeth as described in U.S. Pat. No. 8,735,605 issued to Ruhl, et. al., the contents of which are incorporated herein by reference.

The work machine 12 may be any common tractor or work vehicle that can support the trenching assembly 14. The work machine 12 shown in FIG. 1 comprises a tractor having wheels 26; however, a tracked vehicle or a pedestrian work machine may also be used with the trenching assembly.

The system to further comprises a vacuum hose 28 that may be connected to a vacuum system 27. The vacuum hose 28 is mounted on the work machine 12 and may extend to a vacuum port 30 on the trenching assembly 14. The vacuum system may remove spoils through hose 28 from the trench and hood assembly 20 as the blade 24 cuts the trench.

Figure 2:
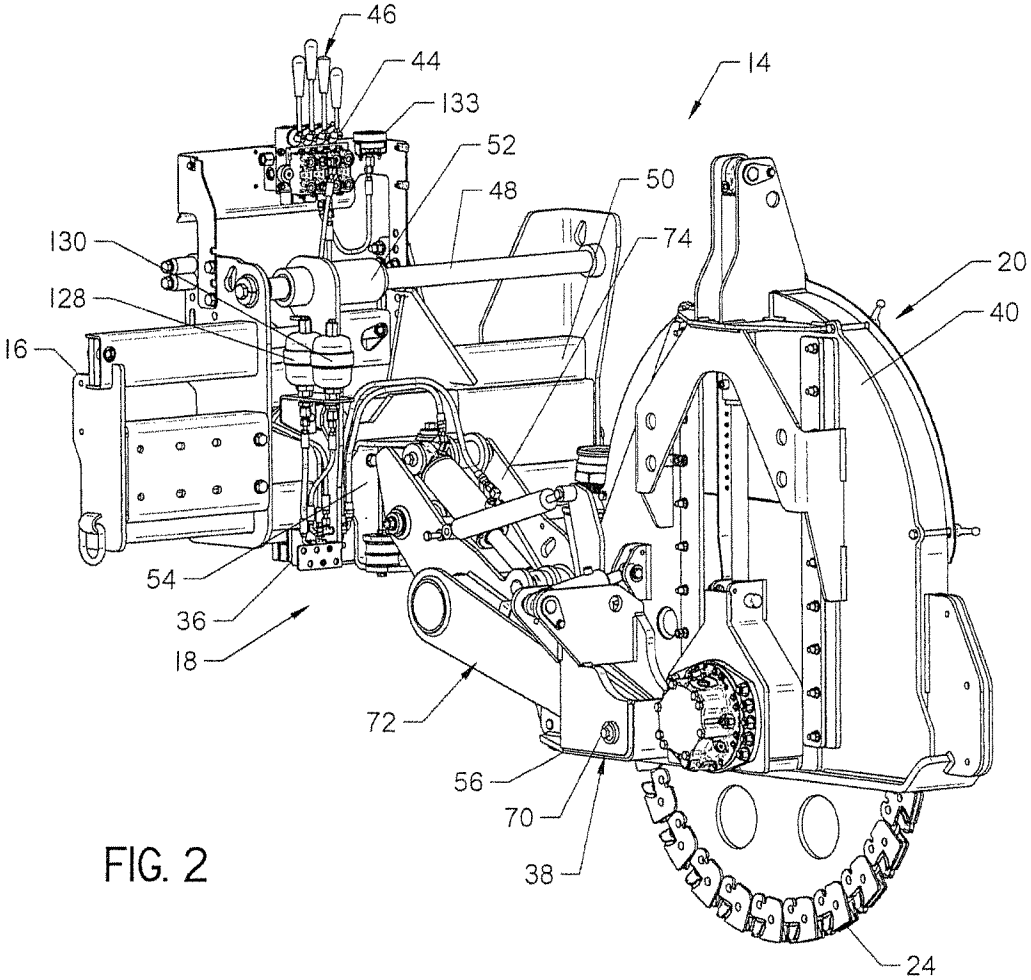
FIG. 2 is a perspective view of a first side of the trenching assembly. Some of the hydraulic lines used to control the assembly have been removed for clarity.
Figure 3:
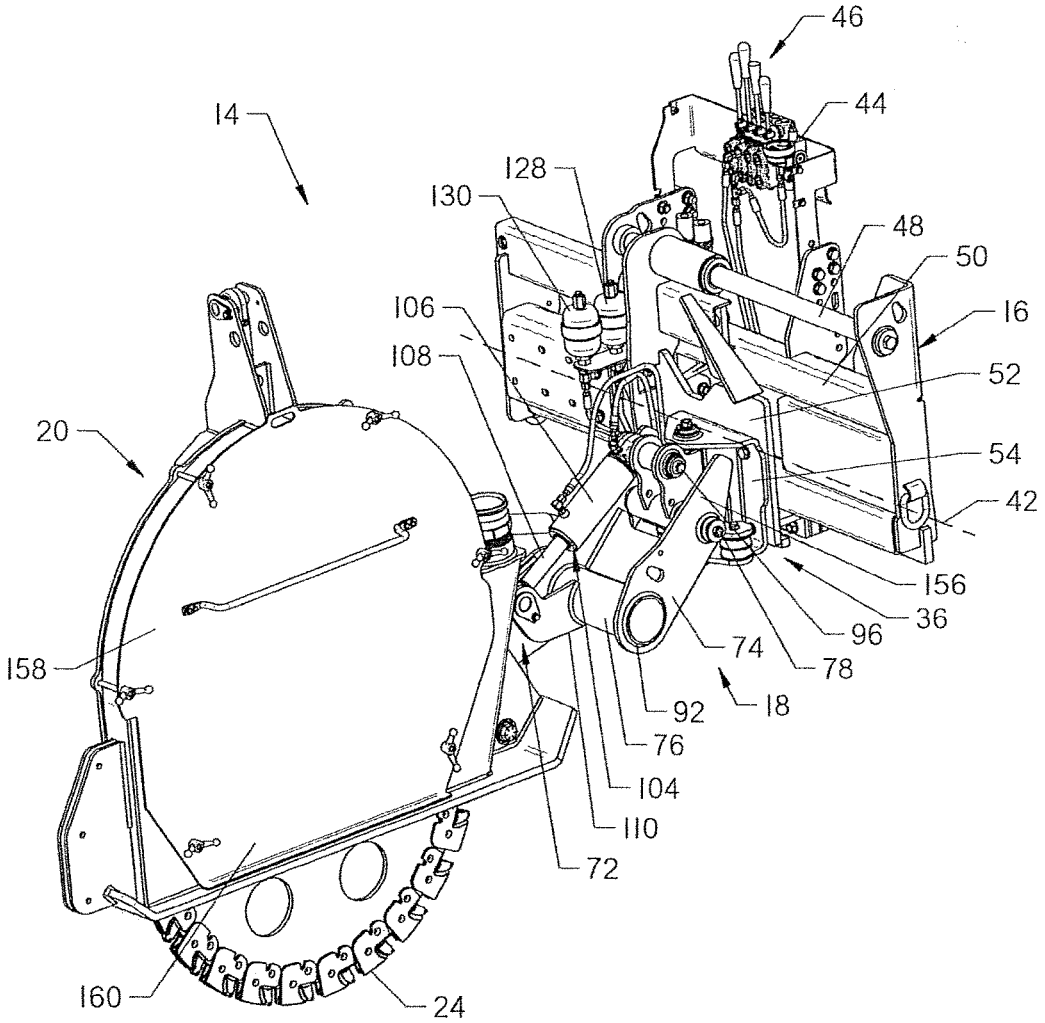
FIG. 3 is a perspective view of a second side of the trenching assembly.

With reference now to FIGS. 2-3, the trenching assembly 14 is shown in more detail. A first side of the trenching assembly 14 is shown in FIG. 2, and a second side of the trenching assembly 14 is shown in FIG. 3. The linkage assembly 18 comprises a frame end 36 and a pivot arm end 38 (FIG. 2). The frame end 36 of the linkage assembly 14 is supported on the attachment frame 16. The pivot arm end 38 is attached to a first side 40 of the hood assembly 20 (FIG. 2).

The attachment frame 16 extends the width of the work machine 12 (FIG. 1) and has a longitudinal axis 42 (FIG. 3). A control panel 44 is attached to the attachment frame 16 opposite the linkage assembly 18. The control panel 44 may also be supported on the rear end 22 of the work machine 12 (FIG. 1). The control panel 44 comprises a set of controls 46 used by an operator to control the operation of the trenching assembly 14.

As shown in FIGS. 2-3, the attachment frame 16 comprises a top rail 48 and a bottom rail 50. A slide member 52 is supported on both the top rail 48 and the bottom rail 50 and may traverse the length of the attachment frame 16 along its longitudinal axis 42 (FIG. 3).

The frame end 36 of the linkage assembly 14 comprises a mount 54 that attaches to the slide member 52. The mount 54 may move side-to-side on the attachment frame 16 with the slide member 52. Thus, the linkage assembly 18 may move along an axis parallel to the longitudinal axis 42 of the attachment frame 16. The trenching assembly 14 is likewise translated about a width of the attachment frame 16.

Figure 4:
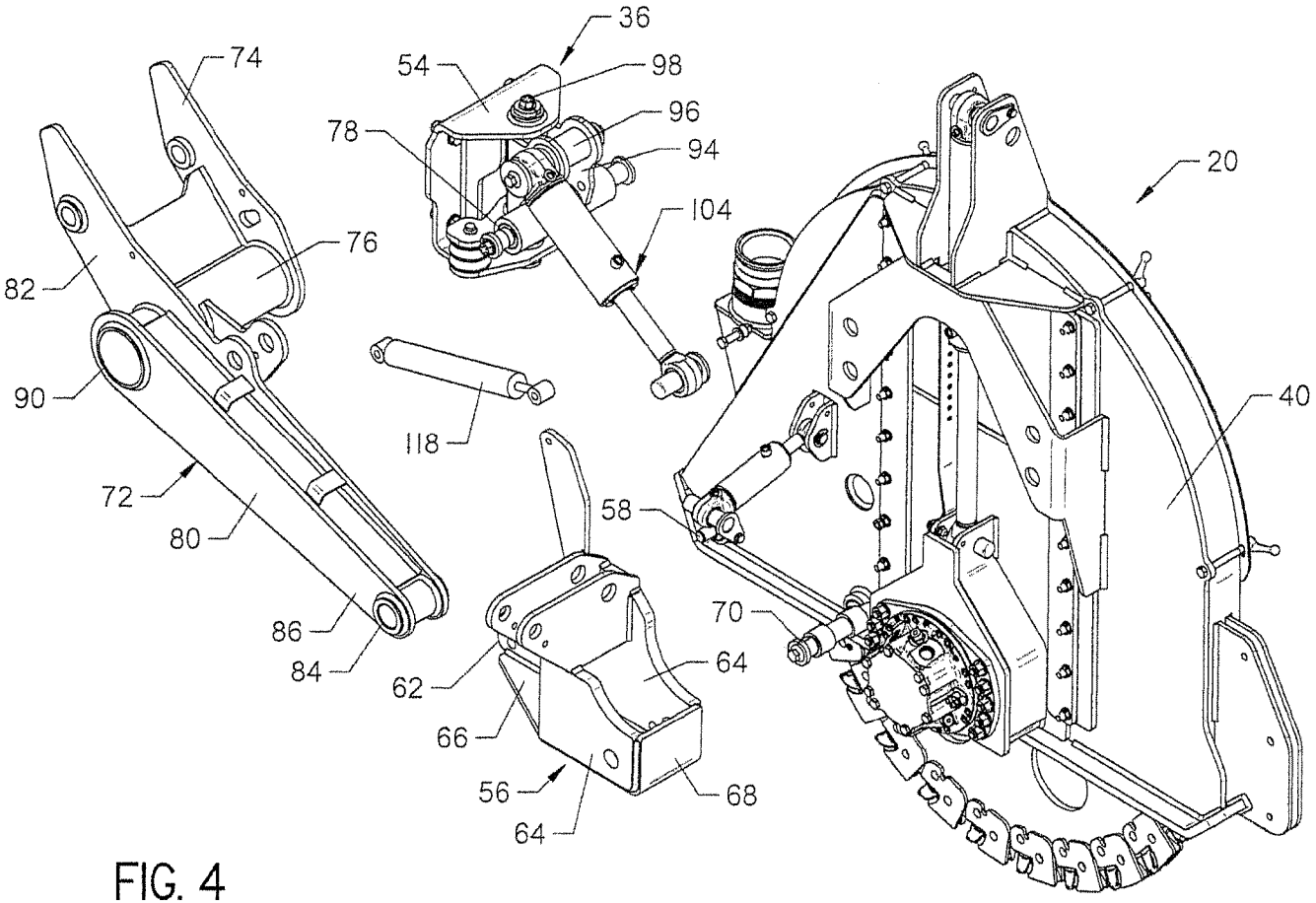
FIG. 4 is a perspective view of a hood assembly and a linkage assembly of the trenching assembly. A portion of the linkage assembly is shown in an exploded view for clarity, and all of the hydraulic lines have been removed for clarity.
Figure 10:
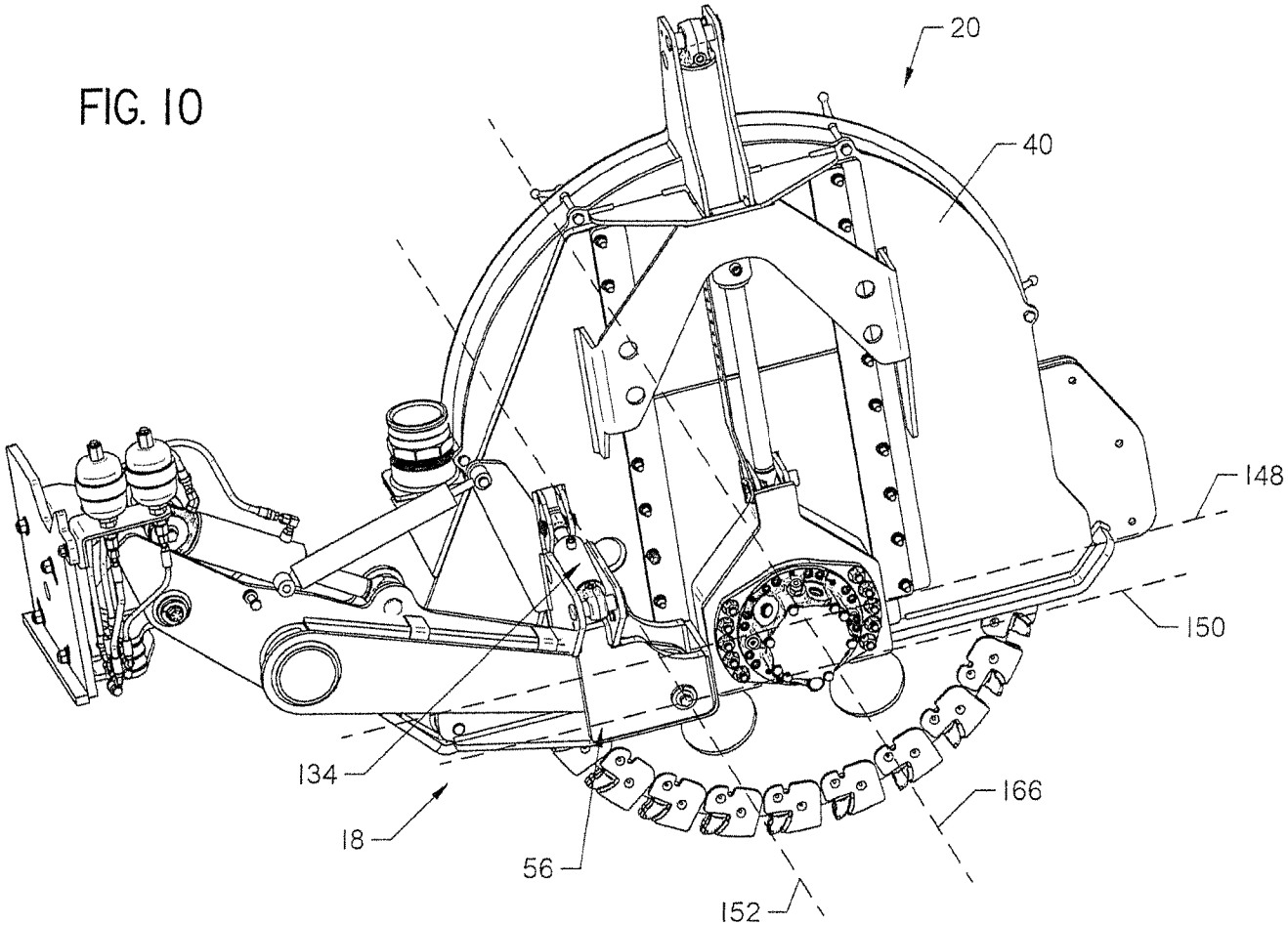
FIG. 10 is a side perspective view of FIG. 6.

With reference to FIGS. 2 and 4, the pivot arm end 38 of the linkage assembly 18 comprises a pivot arm 56 and a first arm 72 joined at a pivot pin 70. The pivot arm 56 provides additional ranges of motion for the hood assembly 20. For example, as shown in FIG. 10, the pivot arm 56 defines a first hood axis 148 and a second hood axis 152. The hood assembly 20 may pivot about the first hood axis 148 relative to the pivot arm 56. Further, the pivot arm 56 and hood assembly 20 may pivot about the second hood axis 152 relative to the first arm 72.

As will be described in more detail below, the additional ranges of motion given to the hood assembly 20 due to the linkage assembly 18 described herein allow for greater freedom of operation of the trenching assembly 14.

As shown in FIG. 4, the pivot arm 56 is releasably attached to the first side 40 of the hood assembly 20 via a first pin 58 and a second pin (not shown). The first pin 58 and the second pin project out from the first side 40 of the hood assembly 20 and fit within holes 62 formed in a side plate 64 of the pivot arm 56. The pivot arm 56 is formed from two side plates 64, a base 66 and an end plate 68. The pivot arm 56 may open at its top and its front. The pivot pin 70 passes through a pair of parallel holes disposed in the side plates 64 proximate the end plate 68 and is secured to the side plates 64 of the pivot arm 56.

Figure 5:
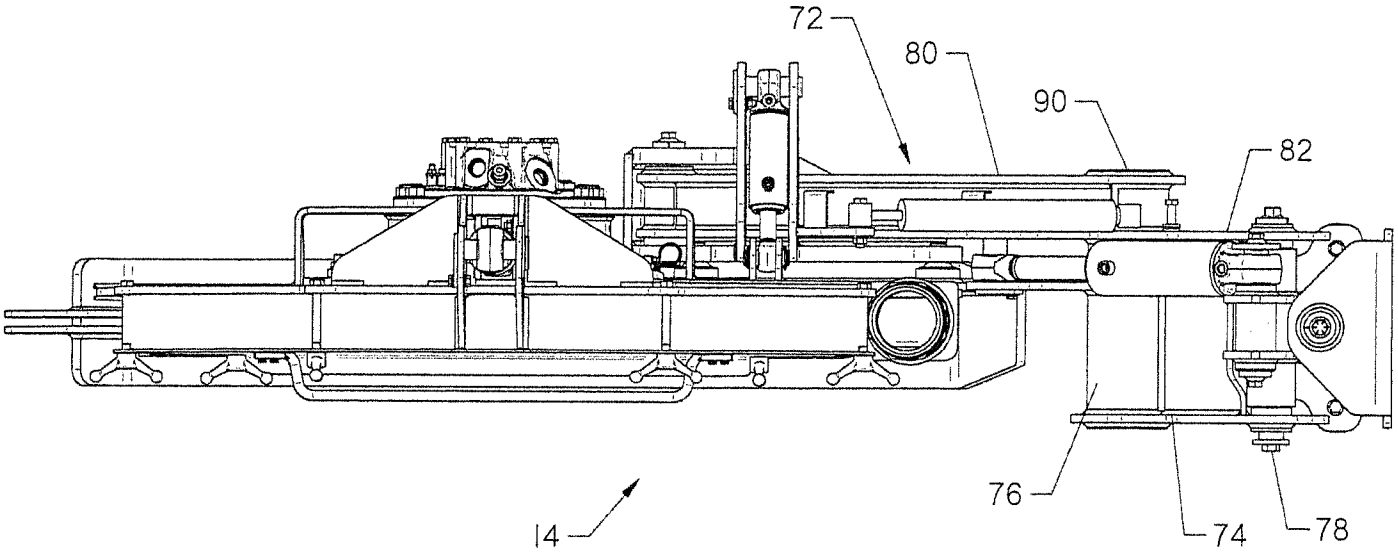
FIG. 5 is a top view of the trenching assembly. Some of the hydraulic lines have been removed for clarity.

Turning to FIGS. 4-5, the linkage assembly 18 comprises the first arm 72 and a second arm 74 that connect the frame end 36 to the pivot arm end 38 of the linkage assembly 18 (FIG. 2). The arms 72, 74 are spaced and longitudinally offset from one another. The arms 72, 74 are rigidly connected via a cross-member 76. The arms 72, 74 are also connected via a horizontal pivot pin 78 (FIG. 5). Alternatively, the linkage assembly 18 may only comprise a single arm.

The first arm 72 comprises a pair of spaced and parallel plates 80 and 82. A pivot pin hole 84 is formed in both plates at an end of the first arm 72 (FIG. 4). The pivot arm end 86 of the first arm 72 is disposed within the opening of the pivot arm 56. The pivot pin 70 passes through the pivot pin hole 84 in the first arm 72 to secure the first arm 72 within the pivot arm 56. The first arm 72 is not rigidly attached to the pivot pin 70. Rather, the first arm 72 can freely pivot about the pivot pin 70 within the pivot arm 56. As discussed in more detail with reference to FIGS. 10-11, the pivot arm 56 is secured to the first side 40 of the hood assembly 20 via a second linear actuator 134, which allows pivotal motion about axis 148.

Continuing with FIGS. 4-5, the first arm 72 has a cross-member passage 90 (FIG. 4) for securing the cross-member 76 to the first arm 72. The first plate 80 of the first arm 72 terminates just after the cross-member passage 90. The second plate 82 of the first arm 72 extends past the cross-member passage go and attaches to the horizontal pivot pin 78 proximate the frame end 36 of the linkage assembly 18.

Turning back to FIG. 3, the second arm 74 comprises a single plate having a cross-member passage 92. The cross-member 76 may be disposed in the cross-member passage 92 to rigidly attach to the first arm 72 (FIG. 2) to the second arm 74. The second arm 74 also attaches to the horizontal pivot pin 78 proximate the frame end 36 of the linkage assembly 18.

As shown in FIG. 4, the horizontal pivot pin 78 is supported in a sub-mount 94 proximate its base. A second horizontal pivot pin 96 is supported in the sub-mount 94 proximate its top. The sub-mount 94 is secured to the mount 54 via a vertical pivot pin 98. The second horizontal pivot pin 96 provides a location for attachment between the sub-mount 94 and a first linear actuator 104.

Figure 6:
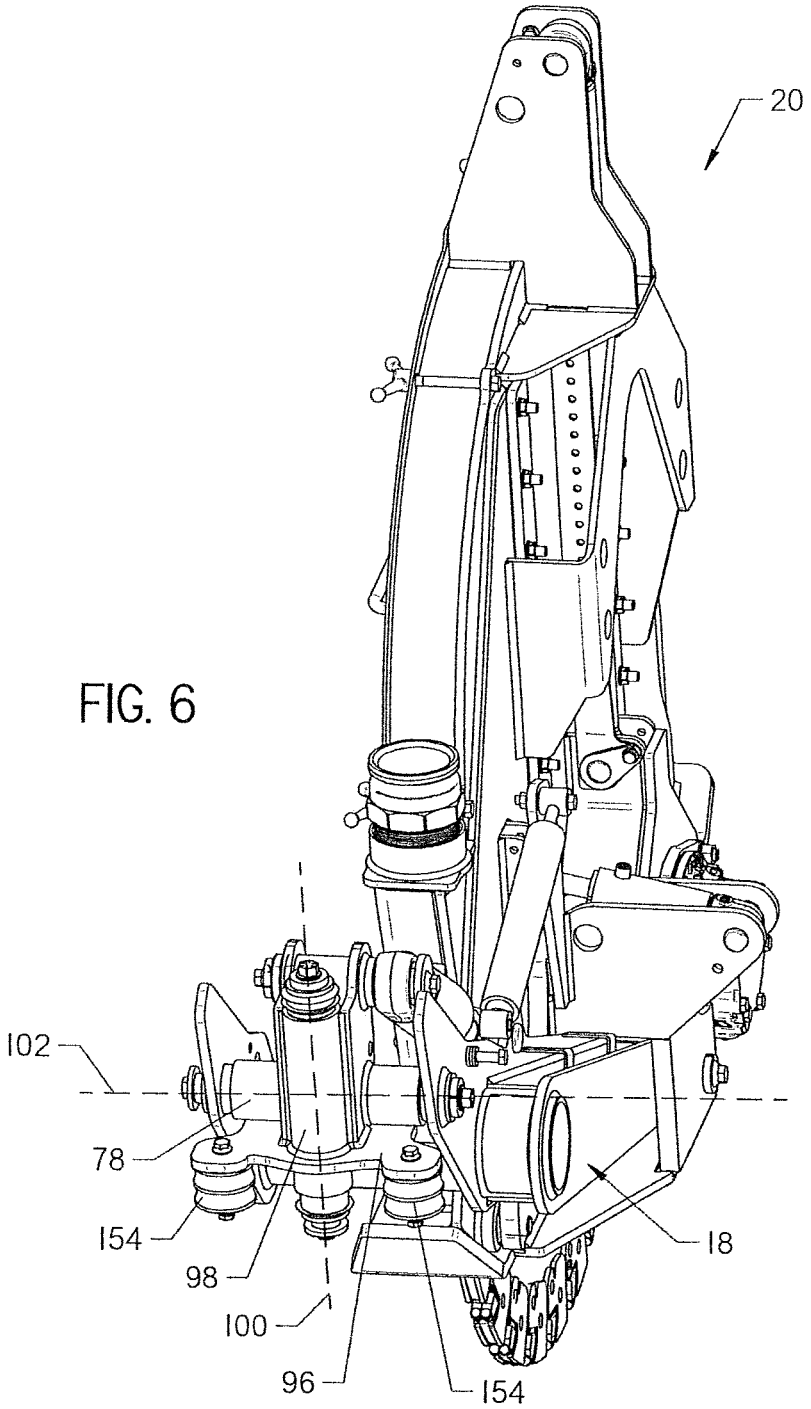
FIG. 6 is a front perspective view of the linkage assembly and hood assembly. All of the hydraulic lines have been removed for clarity.

With reference to FIG. 6, in operation, the linkage assembly 18 may pivot side-to-side about a vertical axis 100 of the vertical pivot pin 98, and may pivot up and down about a horizontal axis 102 of the horizontal pivot pill 78. Pivotal movement of the linkage assembly 18 also moves the hood assembly 20. Thus, the linkage assembly 18 may rotate about two different axes relative to the attachment frame 16 (FIG. 2).

The linkage assembly 18 may pivot about the horizontal axis 102 upon activation of the first linear actuator 104 (FIG. 3). The first linear actuator 104 moves the first arm 72 and the second arm 74 simultaneously because the arms 72, 74 are rigidly connected via the cross-member 76.

Figure 9:
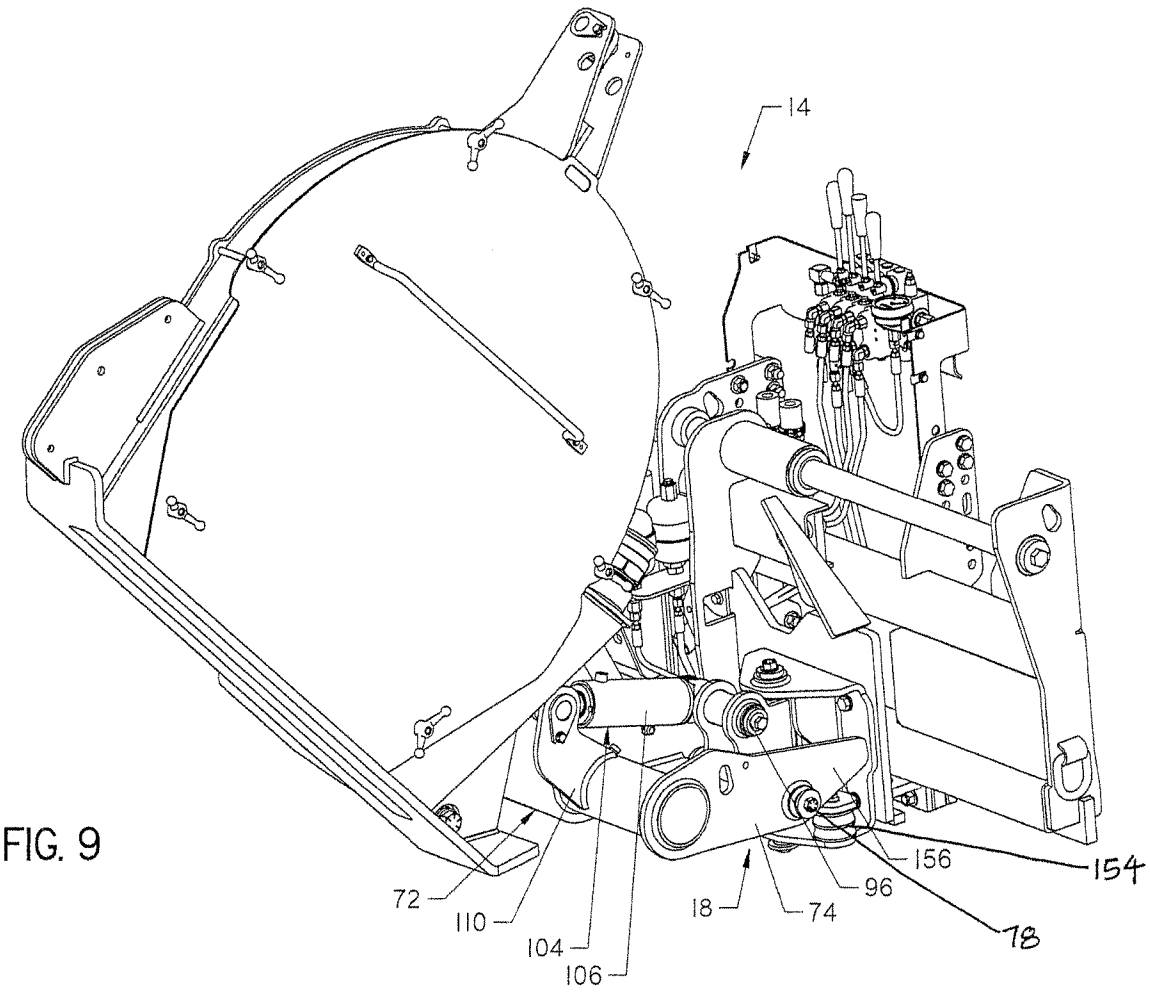
FIG. 9 is a perspective view of the second side of the trenching assembly. The hood assembly is shown pivoted upwards, and some of the hydraulic lines have been removed for clarity.

With reference to FIGS. 3 and 9, the first linear actuator 104 is supported on the linkage assembly 18 between the first arm 72 and the second arm 74. The first linear actuator 104 may comprise a hydraulic cylinder. The hydraulic cylinder comprises a cylinder 106 and a piston 108. The cylinder 106 is attached to the second horizontal pivot pin 96, and the piston 108 is attached to both the first plate 80 of the first arm 72 (FIG. 4) and a support plate no. As shown in FIG. 9, the support plate 110 is a small plate attached to the cross-member 76 between the first arm 72 and the second arm 74. The cylinder 106 is pivotally connected to the second horizontal pivot pin 96, and the piston 108 is rigidly connected to the first arm 72 and the support plate 110.

Figure 7:
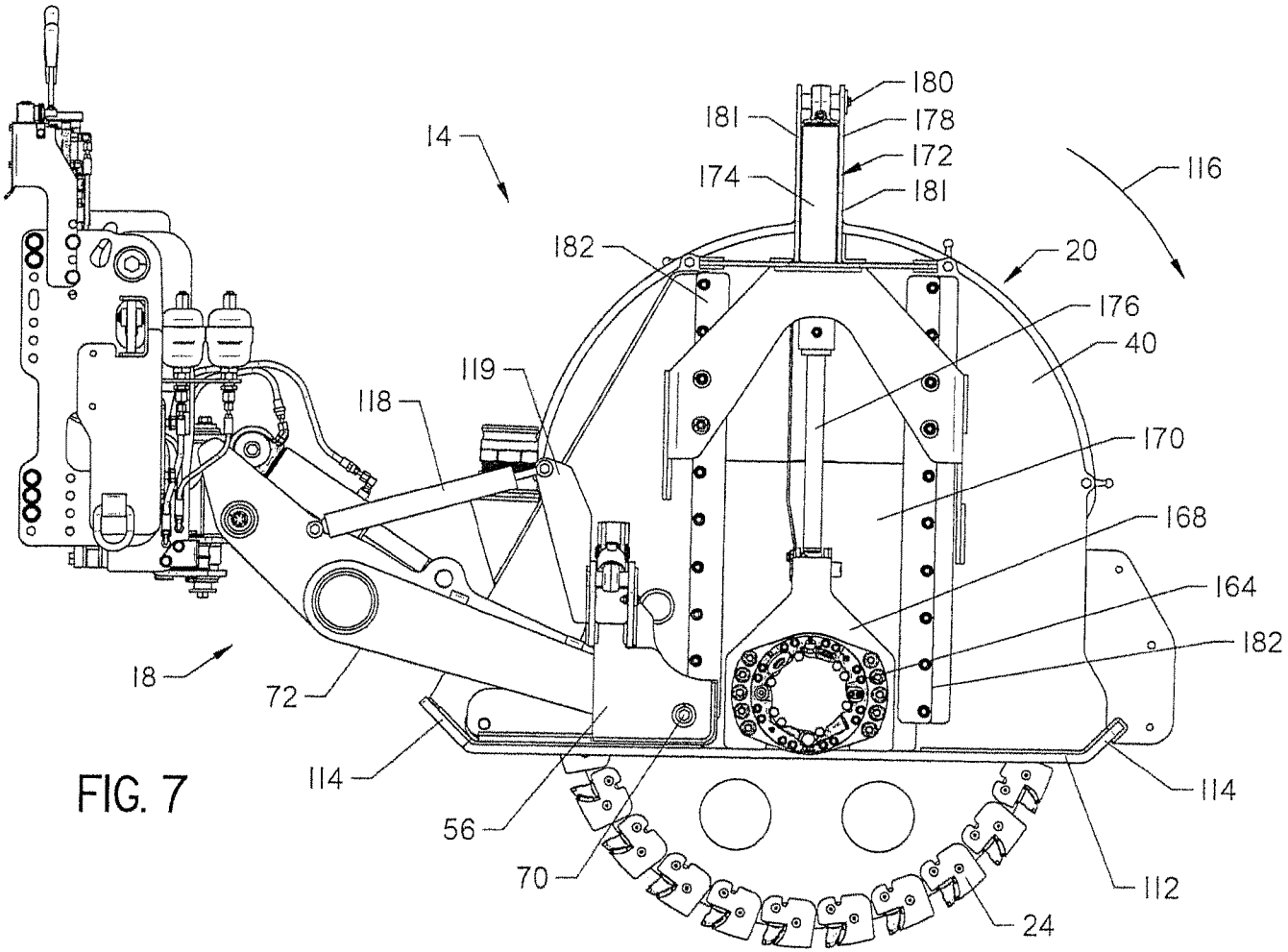
FIG. 7 is a side view of the first side of the trenching assembly shown in FIG. 2.

Turning now to FIG. 7, an elongate surface-engaging member 112 is formed at the base of the hood assembly 20. The surface-engaging member 112 rests on the ground surface as the trenching assembly 14 operates. The surface-engaging member 112 has a flat middle portion and winged ends 114. The pivot arm 56 is shown attached to the first side 40 of the hood assembly 20 just above the surface-engaging member 112.

Because the first arm 72 is pivotally connected to the pivot arm 56 via the pivot pin 70, the hood assembly 20 can freely pivot relative to the first arm 72. Due to this, when the linkage assembly 18 pivots upwards, the hood assembly 20 is free to pivot in the direction of arrow 116. The hood assembly 20 may pivot in the direction of arrow 116 until one of the winged ends 114 of the surface-engaging member 112 contacts the first arm 72. Such contact prevents the hood assembly 20 from pivoting any further in the direction of arrow 116. The hood assembly 20 may pivot up to at least 15° before the winged end 114 contacts the first arm 72, though other maximum pivot angles, such as 5°-30°, are mechanically possible.

A shock absorber 118 is attached to the first arm 72 and the pivot arm 56 via a support 119. The shock absorber 118 slows the speed at which the hood assembly 20 rotates relative the first arm 72 due to incongruities in the ground surface. This prevents the hood assembly 20 from rotating forward too quickly during operation and causing damage to the trenching assembly 14.

Turning back to FIG. 2, the trenching assembly 14 is operated via the controls 46. Each of the controls 46 is connected to a hydraulic line that supplies hydraulic fluid to a part of the trenching assembly 14. As shown in greater detail in FIG. 8, a first end 120 of the cylinder 106 is connected to a first hydraulic line 122, and a second end 124 of the cylinder 106 is connected to a second hydraulic line 126. A first accumulator 128 is also connected to the first hydraulic line 122 between the cylinder 106 and the controls 46 (FIG. 2). Likewise, a second accumulator is connected to the second hydraulic line 126 between the cylinder 106 and the controls 46.

Figure 8:
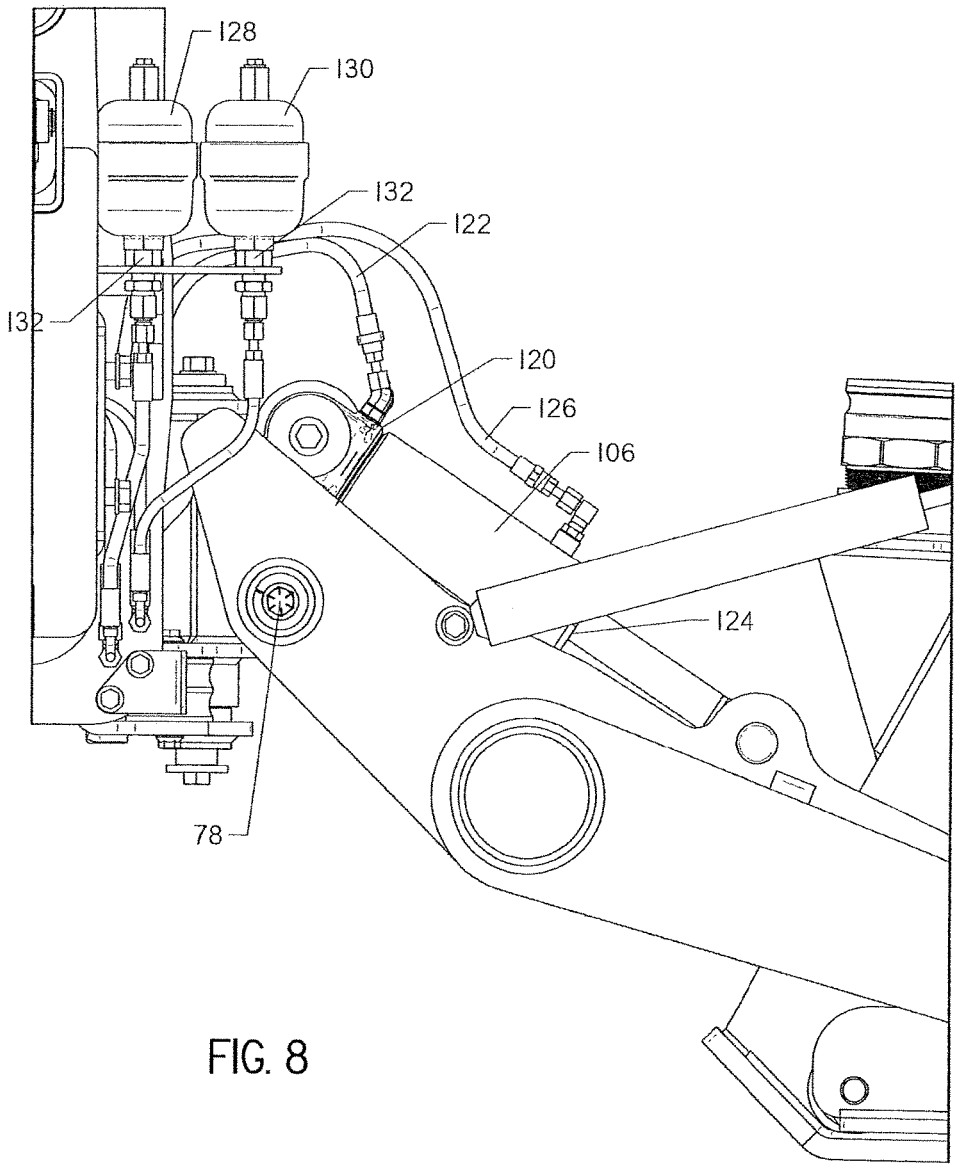
FIG. 8 is a side view of a frame end of the linkage assembly of FIG. 7.

As shown in FIGS. 2-3, the accumulators 128, 130 are supported on the slide member 52. The accumulators 128, 130 may be cylindrical and have an internal chamber (not shown). The hydraulic lines 122, 126 are attached to a bottom end of the accumulators 128, 130 via an inlet 132 (FIG. 8). A bladder is formed within each chamber above the inlet 132 for holding hydraulic fluid. Nitrogen gas may be contained within the chamber above the bladder. Prior to operation, the chamber is filled with nitrogen gas to a desired pressure. For example, the chamber may be filled with nitrogen gas until the chamber reaches 400 psi. To start, it may be advantageous for both the first and second accumulator 128, 130 to have the same set psi or set charge.

In operation, a control 46 connected to the first hydraulic lie 122 may be activated by the operator. Hydraulic fluid may be released into the first hydraulic line 122 and travel to the first accumulator 128. The fluid will fill the bladder of the accumulator 128 until the nitrogen gas is increased to a desired pressure. A gauge 133 on the control panel 44 tells the operator how much pressure has been added to the accumulator 128 (FIG. 2). For example, the bladder may be filled with fluid until the nitrogen gas within the chamber reaches 1000 psi. The fluid will also flow to the cylinder 106 to activate the first linear actuator 104. When the pressure inside the cylinder 106 increases, the piston 108 will be forced out of the cylinder 106. Extension of the piston 108 will force the linkage assembly 18 to rotate downwards about the horizontal pivot pin 78.

To raise the linkage assembly 18, the operator may activate a control 46 connected to the second hydraulic line 126, which is connected to the second accumulator 130 and the cylinder 106. Activation of this control will cause fluid within the first linear actuator 104 to be released into the second hydraulic line 126. This will decrease the pressure within the cylinder 106 and allow the piston 108 to retract into the cylinder 106. Retraction of the piston 108 into the cylinder 106 will force the linkage assembly 18 to rotate upwards about the horizontal pivot pin 78 (FIG. 9).

Fluid entering the second hydraulic line 126 from the first linear actuator 104 will travel to the second accumulator 130 and enter the second accumulator through the inlet 132. When this occurs, the bladder within the second accumulator 130 will fill with fluid and increase the pressure within the chamber of the second accumulator. Simultaneously, fluid will drain from the bladder in the first accumulator 128, decreasing the pressure of the nitrogen gas within the first accumulator 128.

During operation, the hydraulic fluid travels automatically between the accumulators 128, 130 and the first linear actuator 104 in response to changes in depth of the surface. For example, if the surface decreases in depth, the downward movement of the hood assembly 20 will pull on the piston 108 and draw fluid into the first accumulator 128, increasing the pressure within the cylinder 106. This will cause the piston 108 to extend forward. If the surface increases in depth, the upward movement of the hood assembly 20 will push on the piston 108 and draw fluid into the second accumulator 130, decreasing the pressure within the cylinder 106. This will cause the piston 108 to retract back into the cylinder 106.

Because the pivot arm 56 attached to the hood assembly 20 can freely rotate relative to the first arm 72, the hood assembly 20 will also rotate independently of the linkage assembly 18 in response to changes in depth of the surface. This, in conjunction with the action of accumulators 128, 130 described above allows the depth of the trench being cut by the blade 24 to remain uniform as it travels over a non-uniform ground surface. Without the accumulators 128, 130 the first linear actuator 104 can only be activated upon manipulation of the controls 46 by the operator.

Alternatively, the trenching assembly 14 may also use only one accumulator. In such case a valve would be used in a first hydraulic line to direct fluid between the accumulator, the linear actuator, and a second hydraulic line.

Figure 11:
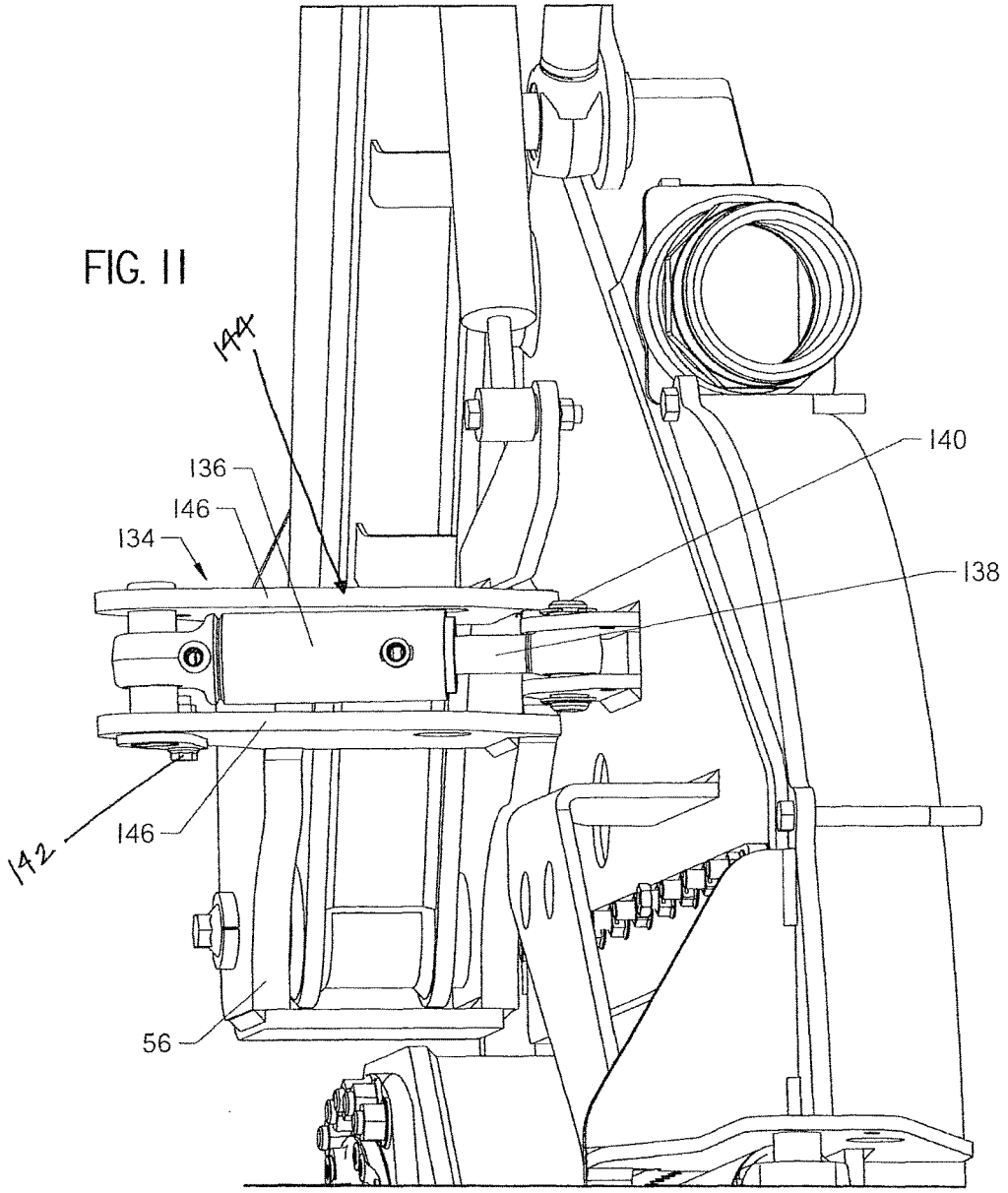
FIG. 11 is the view of FIG. 5 zoomed in to show a pivot arm end of the linkage assembly in more detail.

Turning now to FIGS. 10-11, the second linear actuator 134 is shown attached to the first side 40 of the hood assembly 20. As shown in FIG. 11, the second linear actuator 134 shown is a hydraulic cylinder comprising a cylinder 136 and a piston 138. The piston 138 is attached via a pin 140 to the first side 40 of the hood assembly 20. The cylinder 136 is attached via a pin 142 to a bracket 144. The bracket 144 comprises a pair of spaced and parallel plates 146 that are supported on top of the pivot arm 56. The second linear actuator 134 is disposed between the plates 146.

When the piston 138 is extended from the cylinder 136, the piston 138 forces the hood assembly 20 to tilt or rotate away from the first arm 72 and the pivot arm 56. The pivot arm 56 may release from the pin 58 (FIG. 4) as the hood assembly 20 rotates. The linkage assembly 18 remains in the same position as the hood assembly 20 rotates. Retraction of the piston 138 into the cylinder 136 pulls the hood assembly 20 back to its upright starting position. The second linear actuator 134 holds the pivot arm 56 against the first side 40 of the hood assembly 20 when the piston 138 is fully retracted within the cylinder 136. Alternatively, the starting position of the hood assembly 20 may be with the piston 138 slightly extended so that the hood assembly 20 may be titled in two different directions by extension or retraction of the piston.

As shown in FIG. 10, the second linear actuator 134 allows the hood assembly 20 to rotate about a first hood axis 148 that is parallel to a longitudinal axis 150 of the pivot arm 56. The hood assembly 20 may rotate about the first hood axis 148 up to at least 5°, though greater tilt is possible. Also shown in FIG. 10 is a second hood axis 152 that is perpendicular to the longitudinal axis 150 of the pivot arm 56. The hood assembly 20 and the pivot arm 56 rotate about the second hood axis 152 when the hood assembly 20 and the pivot arm 56 rotate relative to the first arm 72, as discussed with reference to FIG. 7. Thus, the hood assembly 20 may rotate about two different axes relative to the first arm 72 of the linkage assembly 18.

The second linear actuator 134 is controlled by a hydraulic line attached to the cylinder 136 on one end and one of the controls 46 on the opposite end. The second linear actuator 134 is not connected to an accumulator. Rather, the operator must manually adjust the tilt angle of the hood assembly 20 using the controls 46.

Turning back to FIG. 6, a pair of isolators 154 are shown supported on the base of the sub-mount 96. The vertical pivot pin 98 is disposed between and connected to each isolator 154. The isolators 154 are rubber and act similar to a biaser or a spring.

When the linkage assembly 18 is at a right angle to the attachment frame 16 (FIG. 3), the isolators 154 are in a resting position. When the linkage assembly 18 pivots from side-to-side about the vertical pivot pin 98 the body of the isolators 154 may twist or shear. The isolators 154 always want to return to their resting position. Thus, the isolators 154 prevent the linkage assembly 18 from pivoting side-to-side during normal operation without a command from the controls 46. The linkage assembly 18 may pivot about the vertical pivot pin 98 in response to manipulation of one of the controls 46. The linkage assembly 18 may pivot up to at least 10° on each side.

Turning back to FIG. 3, the second arm 74 has an end portion 156 that extends past the horizontal pivot pin 78. When the linkage assembly 18 is pivoted upwards, the end portion 156 will pivot into a space between the mount 54 and the slide member 52 and above the first isolator 154 (FIG. 9). A portion of the slide member 52 is shown removed for clarity. Positioning the end portion 156 between the mount 54 and the slide member 52 prevents the linkage assembly 18 from rotating side-to-side when the linkage assembly 18 and the hood assembly 20 are pivoted upwards.

Figure 12:
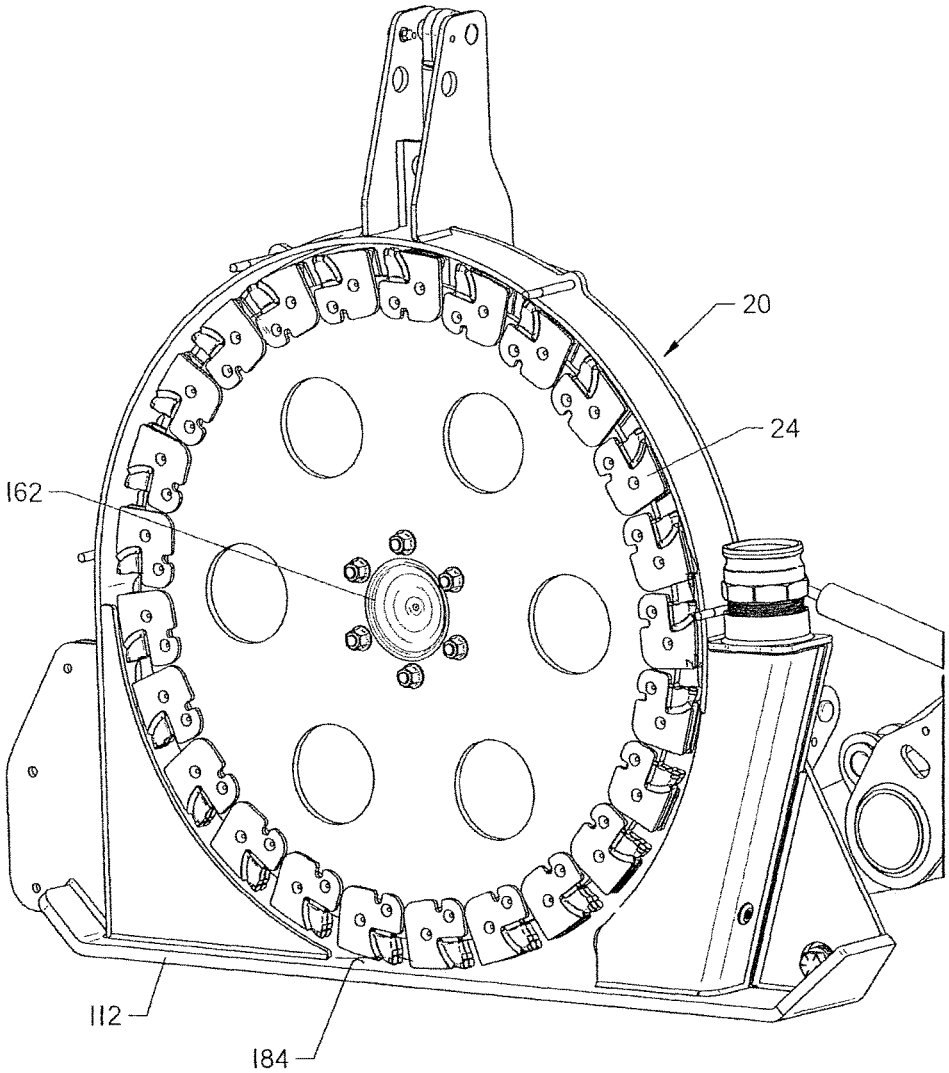
FIG. 12 is a side perspective view of a second side of the hood assembly. One of the hood plates has been removed to expose a blade within the hood assembly. The blade is shown fully contained within the hood assembly.

A second side 158 of the hood assembly 20 is also shown in FIG. 3. The second side 158 has a removable plate 160. The plate 160 is shown removed in FIG. 12. The rotatable blade 24 is supported on a hub 162, as shown in FIG. 12, within the hood assembly 20.

Turning back to FIG. 7, the hub 162 (FIG. 12) is attached to a motor 164 positioned on the outside of the hood assembly 20. The motor 164 rotates the hub 162 which rotates the blade 24. The blade 24 rotates about a blade axis 166 that is orthogonal to the first hood axis 148 (FIG. 10). The motor 164 is supported within a motor box 168 The motor box 168 is attached to a guide plate 170 and a third linear actuator 172. The third linear actuator 172 shown is a hydraulic cylinder comprising a cylinder 174 and a piston 176. Such cylinders may be used to adjust a depth of blade 24 as described in U.S. Patent Pub. No. 2015/0218777, issued to Sewell, the contents of which are incorporated herein by reference.

The cylinder 174 is attached to a bracket 178 via a pin 180. The bracket 178 comprises a pair of spaced and parallel plates 181 attached to the top of the hood assembly 20. The plates 181 are connected at their top via the pin 180.

The piston 176 is attached to the motor box 168. The guide plate 170 may slide up and down the first side 40 of the hood assembly 20 between a pair of guides 182. When the piston 176 is extended from the cylinder 174, the piston pushes the motor box 168 and the guide plate 170 downwards. This is turn pushes the blade 24 downwards and out of the cavity within the hood assembly 20. The blade 24 exits the hood assembly 20 through an opening 184 (FIG. 12) formed in the surface-engaging member 112.

When the piston 176 is retracted within the cylinder 174, the motor box 168 and guide plate 170 are pulled upwards towards the top of the hood assembly 20. This in turn retracts the blade 24 back into the cavity within the hood assembly 20. The third linear actuator 172 is controlled via a hydraulic line attached to one of the controls 46. The blade 24 may be extended out of the hood assembly 20 and past the surface-engaging member 112 up to at least 16 inches. The farther the blade 24 is extended out of the hood assembly 20, the deeper the trench cut by the blade 24.

The blade 24 and the hood assembly 20 may vary in size depending on the size of the trench to be cut. For example, the operator may use a small blade to cut a narrow and shallow trench. The size of the hood assembly 20 corresponds with the size of the blade 24.

Figure 14:
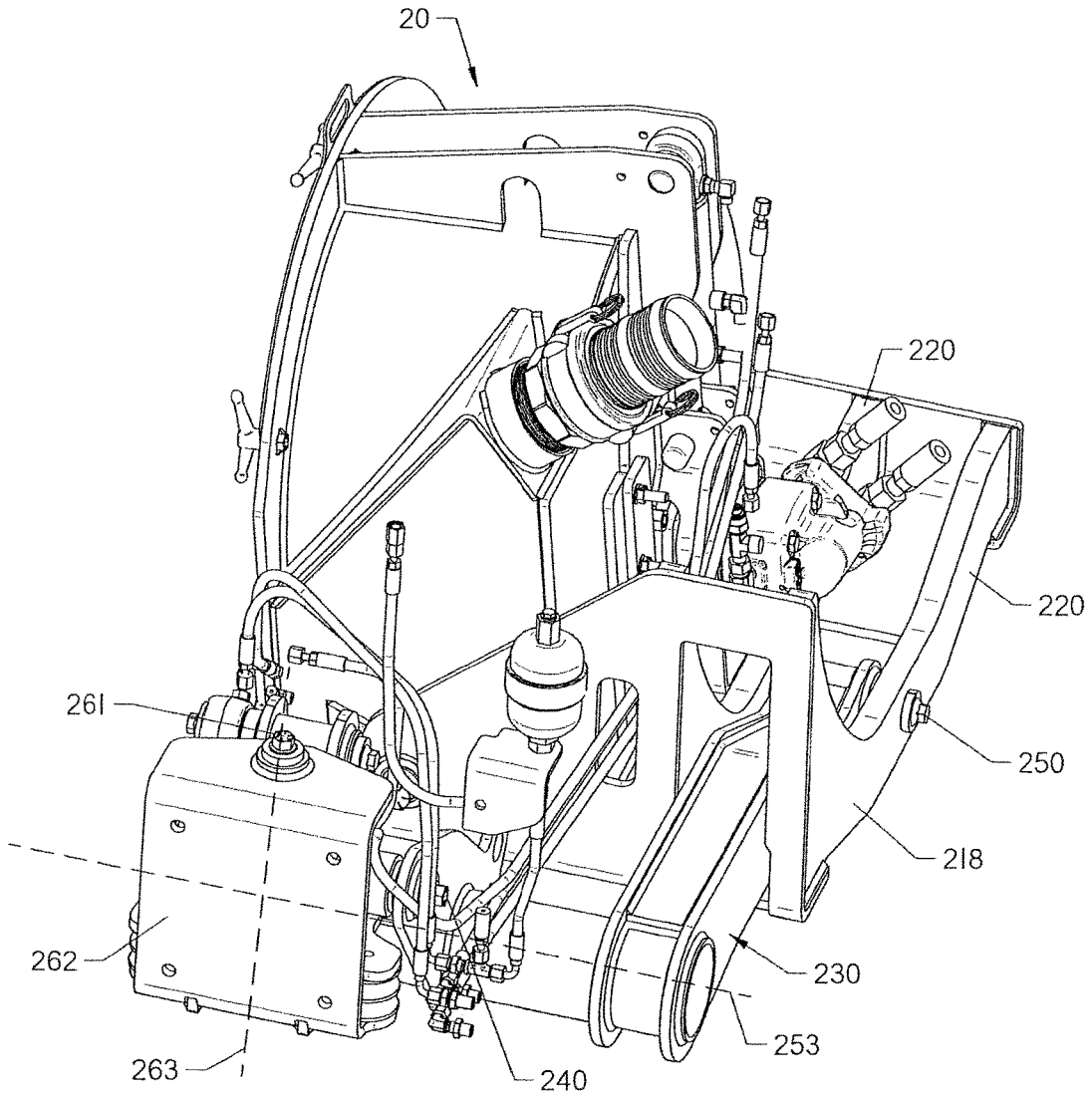
FIG. 14 is a front perspective view of a linkage assembly and a hood assembly of the alternative embodiment of the trenching assembly.
Figure 15:
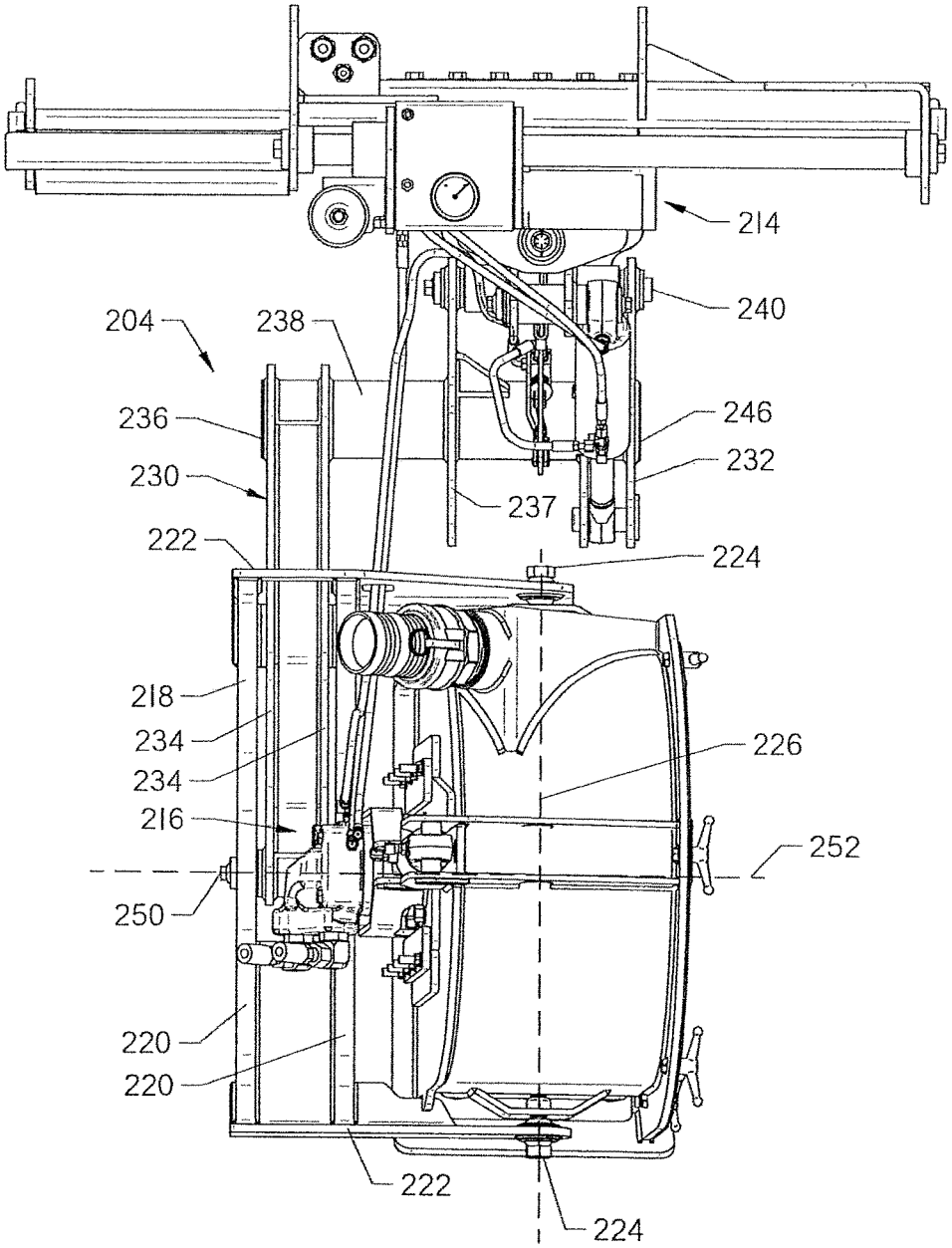
FIG. 15 is a top view of the alternative embodiment of the trenching assembly.
Figure 16:
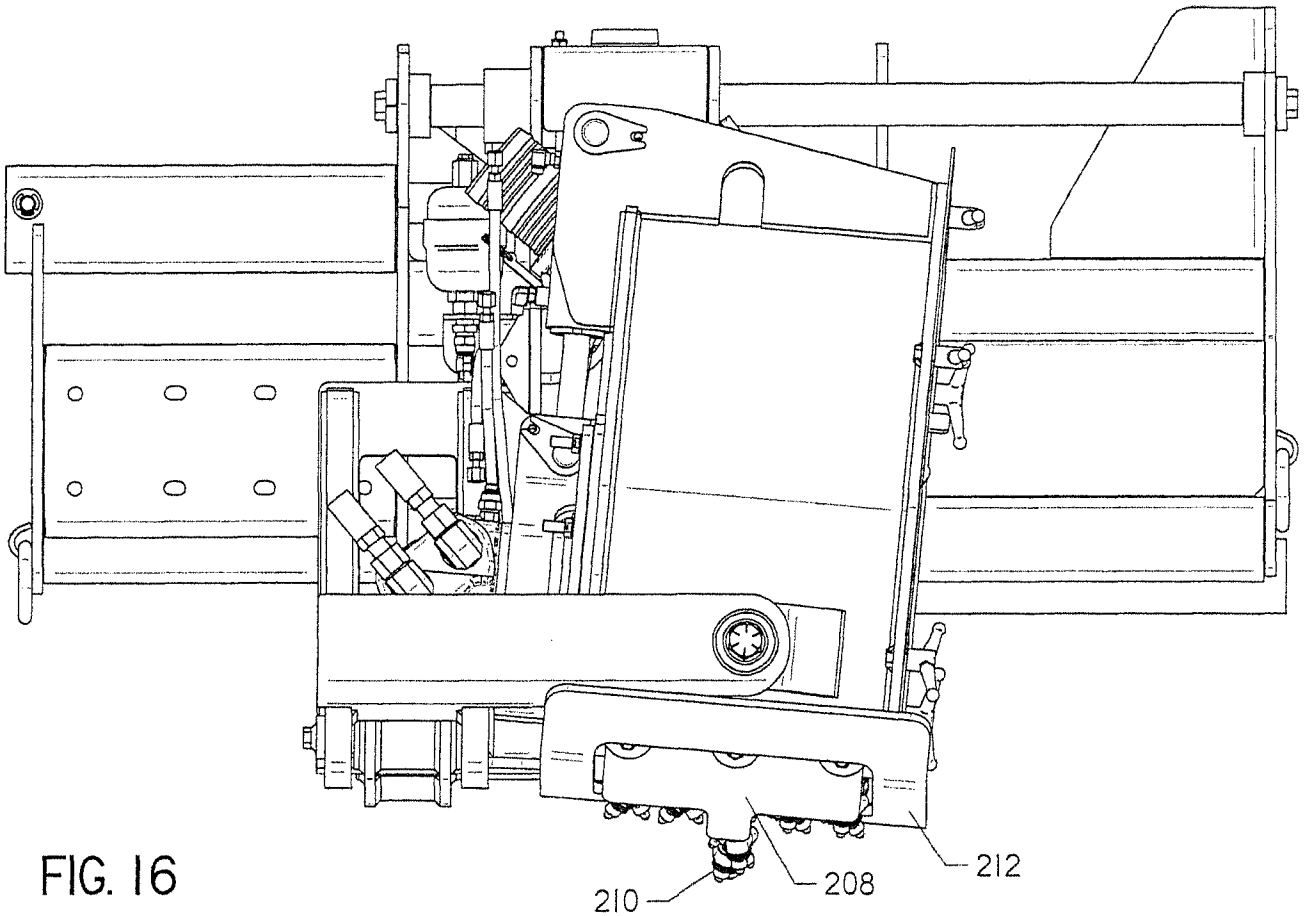
FIG. 16 is a rear view of the alternative embodiment of the trenching assembly.

Turning now to FIGS. 13-16, an alternative embodiment of the trenching assembly 200 that may be pulled behind a work machine 12 (FIG. 1) is shown. The trenching assembly 200 comprises a hood assembly 202, a linkage assembly 204, and an attachment frame 206. The hood assembly 202 is wider than that shown in FIGS. 2-3, because it houses a wider blade 208 (FIG. 16). The blade 208 shown in FIG. 16 has multiple rows of teeth 210. Such a blade 208 cuts a trench in the shape of a "T" in a surface, as is described with more particularity in U.S. Pat. Pub. 2017/0101746 issued to Sewell, the contents of which are incorporated herein by reference. The hood assembly 202 has a surface engaging member 212 formed at its base. The blade 208 may be extended past the surface-engaging member 212 to a desired depth.

Figure 13:
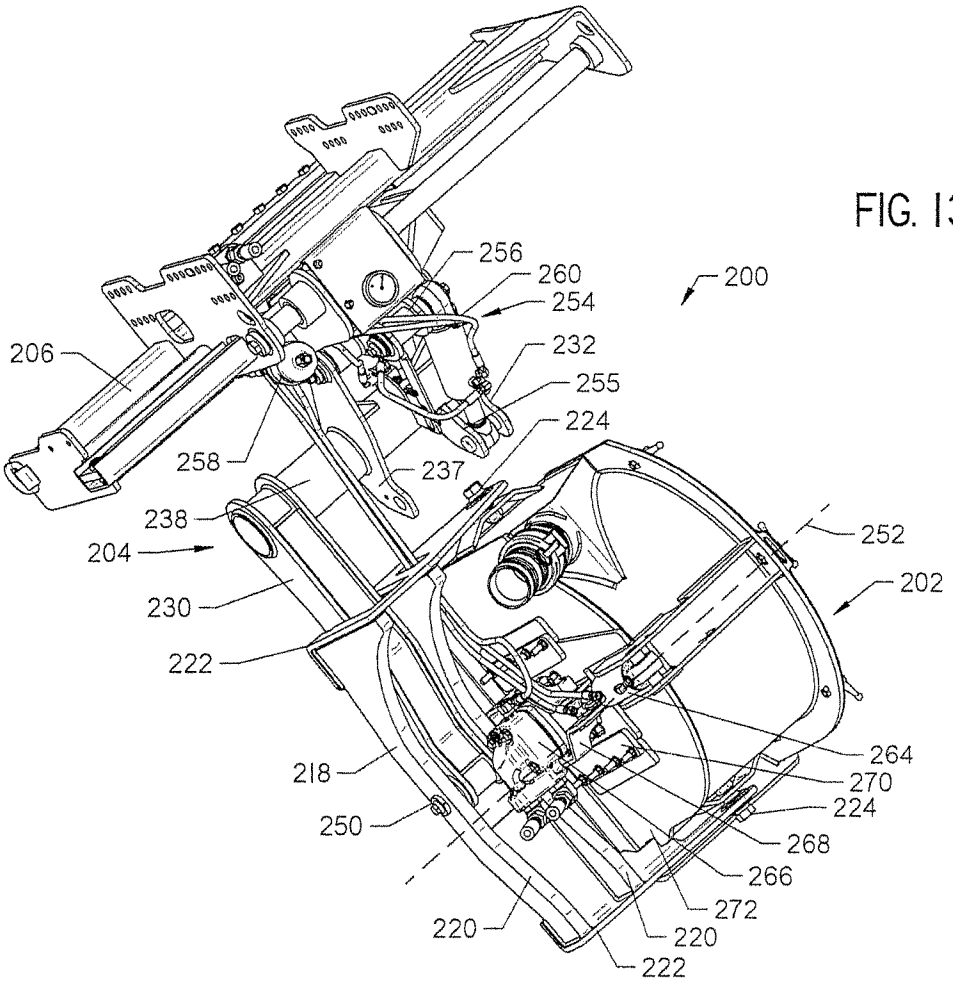
FIG. 13 is a top perspective view of a first side of an alternative embodiment of the trenching assembly.

With reference to FIGS. 13 and 15, the linkage assembly 204 comprises a frame end 214 and a pivot arm end 216 (FIG. 15). The frame end 214 is configured like the frame end 36 shown in FIG. 2. The pivot arm end 216 comprises a pivot arm 218. The pivot arm 218 comprises two spaced and parallel plates 220. The plates 220 extend the length of the hood assembly 202. A pair of support members 222 are secured to opposite ends of the plates 220 and are pivotally secured to opposite ends of the hood assembly 202 at pivot pins 224. The pivot pins 224 are positioned on a first hood axis 226 (FIG. 15). The hood assembly 202 may freely pivot about the first hood axis 226. The first hood axis 226 is parallel to a longitudinal axis of the pivot arm 218.

Continuing with FIG. 15, the linkage assembly 204 further comprises a first arm 230 and a second arm 232 that connect the frame end 214 to the pivot arm end 216. The first arm 230 comprises a pair of spaced and parallel plates 234 having a cross-member passage 236. Both plates 234 terminate just after the cross-member passage 236. The plates 234 are attached to a third plate 237 via the cross-member 238. The third plate 237 is attached to a horizontal pivot pin 240 and is spaced from and parallel to the second arm 232. The third plate 237 and the second arm 232 are rigidly connected via the cross-member 238.

The second arm 232 is a single plate having a cross-member passage 246. The second arm 232 extends past the cross-member passage 246 and attaches to the horizontal pivot pin 240.

With reference to FIGS. 13-15, the pivot arm 218 is attached to the first arm 230 via a pivot pin 250. The first arm 230 is disposed between the plates 220 of the pivot arm 218. The first arm 230 may pivot freely about the pivot pin 250. Thus, the pivot arm 218 and the hood assembly 202 may rotate freely relative to the first arm 230. This allows the hood assembly 202 and the pivot arm 218 to rotate about a second hood axis 252 that is perpendicular to the longitudinal axis 228 of the pivot arm 218 (FIG. 15). Thus, the hood assembly 202 may rotate about two different axes relative to the first arm 230 of the linkage assembly 204.

With reference to FIG. 13, the linkage assembly 204 may rotate about a horizontal axis 253 (FIG. 14) of the horizontal pivot pin 240 via activation of a first linear actuator 254. The first linear actuator 254 is attached to a second horizontal pivot pin 256 on one end and the second arm 232 and a support plate 255 at its opposite end. An accumulator 258 may be connected to a first hydraulic line 260 and the first linear actuator 254 to allow the first linear actuator 254 to operate without input from the operator in response to depth changes in the ground surface. The first linear actuator 254 may also use two accumulators as described with reference to FIG. 8.

Turning back to FIG. 14, the linkage assembly 204 may also rotate side to side about a vertical axis 263 of a vertical pivot pin 261 supported on a mount 262. The horizontal pivot pin 240 is also supported on the mount 262. The linkage assembly 204 may move from side-to-side as needed on the attachment frame 206 (FIG. 13) via movement of the mount 262.

Turning back to FIG. 13, the hood assembly 202 also comprises a second linear actuator 264 used to move a motor 266 attached to a motor box 268 up and down between a pair of guides 270 on a first side 272 of the hood assembly 202. The motor 266 is attached to a hub (not shown) within the hood assembly 202. The blade 208 (FIG. 16) is supported on the hub in the hood assembly 202. Rotation of the hub also rotates the blade 208. The vertical movement of the motor 266 caused by the second linear actuator 264 also moves the blade 208 in and out of the hood assembly 202.

In operation using the trenching assembly 14 or 200, the surface-engaging member 112, 212 of the hood assembly 20, 202 is first positioned on the surface to be cut by the trenching assembly 14, 200. The operator adjusts the vertical position of the blade 24, 208 relative to the surface-engaging member 112, 212 to achieve the desired depth of the trench. The blade 24, 208 is then continually rotated. The work machine 12 will be driven in the desired direction of travel pulling the trenching assembly 14, 200 behind it. As the surface being cut varies in depth, the hydraulic fluid will move between the accumulators 128, 130, 258 and the first linear actuator 104, 254. Such movement of the fluid will manipulate the first linear actuator 104, 254 as needed to maintain the position of the blade 24, 208 at the desired depth within the surface.

If needed, the operator may manipulate the controls 46 connected to the vertical pivot pin 98, 260 to position the linkage assembly 14, 200 at an angle relative the attachment frame 16, 206. If the operator is using the trenching assembly 14, the operator may manipulate the controls 46 connected to the second linear actuator 134 to tilt the hood assembly 20 relative to the linkage assembly 18. If the operator is using the trenching assembly 200, the hood assembly 202 will freely rotate about the first hood axis 226 as needed. The operator may also move the linkage assembly 14, 200 side-to-side on the attachment frame 16, 206 to position the trenching assembly 14, 200 behind the work machine 12 as needed.

Various modifications can be made in the design and operation of the present invention without departing from the spirit thereof. Thus, while the principle preferred construction and modes of operation of the invention have been explained in what is now considered to represent its best embodiments, which have been illustrated and described, it should be understood that the invention may be practiced otherwise than as specifically illustrated and described.

The invention claimed is:

1. A trenching assembly comprising:

a frame that extends along a longitudinal axis;

a hood assembly having a surface-engaging member and defining a cavity;

a linkage assembly interconnecting the frame and the hood assembly and comprising a first hydraulic cylinder, in which the linkage assembly is pivotable adjacent the frame about a horizontal axis; and in which the hood assembly is pivotable relative to the linkage assembly about a first hood axis that is perpendicular to the longitudinal axis of the frame; and a rotatable blade at least partially positioned within the cavity, in which the blade is vertically positionable relative to the hood assembly.

2. The trenching assembly of claim 1 in which the hood assembly is characterized by a pair of opposed sides, and in which the linkage assembly comprises a pivot arm attached to only a single side of the hood assembly.

3. The trenching assembly of claim 2 in which the pivot arm is releasably attached to the single side of the hood assembly.

4. The trenching assembly of claim 2 in which the linkage assembly further comprises a mount and a first arm, in which the mount is attached to the frame and the first arm interconnects the mount and the pivot arm.

5. The trenching assembly of claim 2 in which the hood assembly is rotatable relative to the pivot arm.

6. The trenching assembly of claim 2 further comprising a pin projecting from the single side of the hood assembly that is releasably engageable with the pivot arm.

7. The trenching assembly of claim 2 in which the pivot arm has a flat bottom surface that is positioned parallel to the surface-engaging member.

8. The trenching assembly of claim 2 in which the pivot arm is attached to the single side of the hood assembly via a third hydraulic cylinder.

9. The trenching assembly of claim 1 in which activation of the first hydraulic cylinder pivots the linkage assembly about the horizontal axis.

10. The trenching assembly of claim 1 further comprising an accumulator supported on the frame, in which the first hydraulic cylinder is connected via a hydraulic line to the accumulator.

11. The trenching assembly of claim 1 further comprising a first and a second accumulator, the first hydraulic cylinder further comprising a cylinder and a piston, and in which the cylinder is connected via a first hydraulic line to the first accumulator and the piston is connected via a second hydraulic line to the second accumulator.

12. The trenching assembly of claim 1 in which the blade is rotatable about a blade axis that is orthogonal to the first hood axis.

13. The trenching assembly of claim 1 in which the hood assembly is rotatable about a second hood axis that is perpendicular to the first hood axis.

14. The trenching assembly of claim 13 in which the hood assembly is rotatable about the second hood axis relative to the first hood axis within an angular range of about 15 degrees.

15. The trenching assembly of claim 1 further comprising a second hydraulic cylinder configured to pivot the hood assembly about the first hood axis.

16. The trenching assembly of claim 1 in which the linkage assembly is pivotable adjacent the frame about a vertical axis.

17. The trenching assembly of claim 1 in which the linkage assembly is pivotable adjacent the hood assembly about a horizontal axis.

18. The trenching assembly of claim 1 in which the linkage assembly is movable along an axis parallel to the longitudinal axis of the frame.

19. The trenching assembly of claim 1 in which the linkage assembly comprises a pair of spaced and longitudinally offset arms joined by a cross member.

20. A work machine comprising:

a frame;

a motive means for moving the frame; and the trenching assembly of claim 1.

21. A method for cutting a narrow trench in a direction of travel using a rotatable blade attached to a frame via a linkage assembly, wherein the rotatable blade is disposed within a cavity defined by a hood assembly having a surface-engaging member, the method comprising:

positioning the surface-engaging member on the surface adjacent the blade;

adjusting a vertical position of the blade relative to the surface engaging member to achieve the desired trench depth;

rotating the blade to cut a trench;

translating the frame in the direction of travel; and pivoting the hood assembly relative the linkage assembly about an axis parallel to the direction of travel.

22. The method of claim 21 further comprising pivoting the hood assembly about an axis perpendicular to the direction of travel such that the surface engaging member is positioned at a non-zero angle relative to the frame.

23. The method of claim 21 further comprising rotating the linkage assembly adjacent the frame about a vertical axis.

24. The method of claim 21 further comprising rotating the hood assembly relative to an axis parallel to the direction of travel.

25. The method of claim 21 further comprising pivoting the linkage assembly about an axis perpendicular to the direction of travel by passing hydraulic fluid between an accumulator supported on the frame and a hydraulic cylinder attached to the linkage assembly.

* * * * *